US005871091A

United States Patent [19]

Fogle

[11] Patent Number: 5,871,091

[45] Date of Patent: Feb. 16, 1999

[54] PACKAGE AND METHOD OF MANUFACTURE FOR FLEXIBLE CUTTING LINE

[75] Inventor: John R. Fogle, Cave Creek, Ariz.

[73] Assignee: Robert L. Phillips, Scottsdale, Ariz.

[21] Appl. No.: 904,141

[22] Filed: Jul. 31, 1997

[51] Int. Cl.[6] ..... B65D 81/26; B65D 85/00; D02G 3/00

[52] U.S. Cl. ..... 206/205; 206/388; 428/375

[58] Field of Search ..... 206/207, 205, 206/388, 390, 63.5; 428/372, 375, 381

[56] References Cited

U.S. PATENT DOCUMENTS

| | | | |
|---|---|---|---|
| 90,740 | 6/1869 | Gunther | 428/381 |
| 385,937 | 7/1888 | Lee . | |
| 516,934 | 1/1894 | Merson | 206/63.3 |
| 1,355,586 | 10/1920 | Arosio | 428/375 |
| 1,552,133 | 9/1925 | Frey | 206/63.5 |
| 2,058,800 | 10/1936 | Jasper | 206/205 |
| 2,129,414 | 9/1938 | Faw | 428/375 |
| 3,135,565 | 6/1964 | Brigham | 206/205 |
| 3,545,608 | 12/1970 | Berger . | |
| 4,168,000 | 9/1979 | MacRitchie . | |
| 4,497,402 | 2/1985 | Karos . | |
| 4,900,618 | 2/1990 | O'Connor et al. | 428/381 |

*Primary Examiner*—Paul T. Sewell
*Assistant Examiner*—Jila Mohandesi
*Attorney, Agent, or Firm*—LaValle D. Ptak

[57] ABSTRACT

An improved package and method for manufacturing extruded monofilament string trimmer line incorporates preconditioning of the line to provide a high moisture content. The line then is packaged in a sealed package with a removable cap to permit withdrawal of line from the package. A moisture-laden sponge may be placed within the bottom of the package to maintain a high humidity within the package. Copper chloride or cobalt chloride salts also may be coated on the line, or added to the plastic forming the line to provide a color indication of the relative moisture content of the line.

16 Claims, 3 Drawing Sheets

PACKAGE AND METHOD OF MANUFACTURE FOR FLEXIBLE CUTTING LINE

BACKGROUND

Weed and grass trimmers using flexible cutting lines are in widespread use. Many of these trimmers employ a rotatable hub with a short length of nylon or other plastic line extending from the hub. When the hub is rotated, the tip of the line extending from the hub provides the cutting or trimming action. Grass and weed trimmers using this principle of operation have been popular for their versatility of use and because the flexible trim line is safer to use than rigid rotating steel blades.

Various types of trimmer devices have been developed for using such flexible trim lines. Typically, rotating line trimmers or string trimmers employ a line having a generally circular cross section. This line, in many trimmers, is wound on a storage reel in the hub of the device and is played out of a hole in the hub in discrete amounts as the end breaks off or wears off. Other rotatable hub trimmers use fixed lengths of flexible line, which are replaced individually when the line wears down or breaks off.

Generally, the trimmer line which is used in rotating string trimmers is manufactured of extruded nylon monofilament material. The cross-sectional diameters of the line used in the trimmers from a larger cross-sectional diameter for commercial trimmers to smaller diameters in the trimmers sold for intermittent home use. Even though different diameter line sizes are employed, the range of sizes is relatively narrow (typically, 0.050 inches to 0.155 inches in diameter). Trimmer lines which have cross sections other than circular cross sections have been developed in an attempt to provide sharper cutting edges at the point of impact when cutting grass or weeds. Cross-sectional configurations in the form of elongated ribbed lines, or a star-like cross section, or square or triangular cross sections have been developed. The overall cross-sectional dimension, however, still is within the range given above for typical circular lines.

Whether the trim line has a circular cross section or some other cross section, the nylon monofilament line out of which the line is made undergoes relatively rapid wear as a result of the friction or abrasion which takes place when the spinning line contacts the grass and weed stems, as the trimmer is being operated. The rotation of the hub in string trimmers is at relatively high speeds (2,000 to 20,000 RPMs); so that replacement of worn line continuously must be effected during operation of the trimmer. Line wear also has been observed to be greater under dry conditions than under wet or high humidity conditions.

It is desirable to provide an improved flexible trim line which overcomes the disadvantages of the prior art, which is preconditioned so as to wear at a reduced rate, and which is packaged to maintain the preconditioning status of the line.

SUMMARY OF THE INVENTION

It is an object of this invention to provide an improved method of manufacturing trimmer line.

It is another object of this invention to provide an improved trimmer line and method of manufacture for lines made of extruded monofilament plastic.

It is an additional object of this invention to provide an improved method of manufacture and package for extruded nylon string trimmer line.

It is a further object of this invention to provide an improved method of manufacture and package for preconditioning extruded monofilament trimmer line to improve the wearing characteristics of the line when it is being used.

In accordance with a preferred embodiment of this invention, monofilament string trimmer line is preconditioned with a moisturizing agent and then packaged in a sealed package to maintain the moisture content of the line prior to its use. The package may be provided with a sealable closure to permit withdrawal of less than all of the line from the package; whereupon the package may be resealed to maintain the rest of the line in the package in its moisturized condition. In a more specific embodiment of the invention, moisture-indicative additives are incorporated into the line or coated upon it to provide a visual color indication to the user of the relative moisture content of the line.

DETAILED DESCRIPTION

Figure 1:
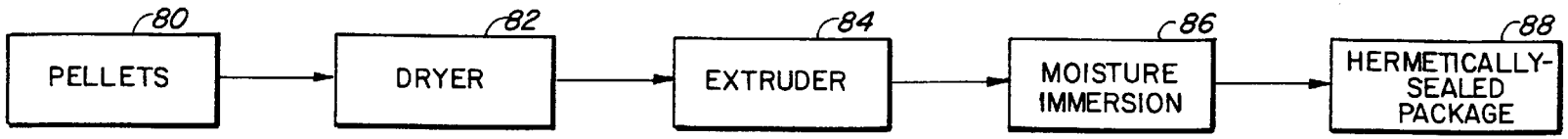
FIG. 1 is a flow chart of a method used to manufacture the trimmer line in accordance with a preferred embodiment of the invention.

Reference now should be made to the drawings, in which the same reference numbers are used throughout the different figures to designate the same or similar components. FIG. 1 is a flow chart of a method of a preferred embodiment of the invention for producing preconditioned nylon monofilament trimmer line exhibiting improved long-wearing operating characteristics.

The first three stages of the production method illustrated in FIG. 1 are conventional. Typically the starter material for the line is in the form of pelletized plastic (nylon, in the present example), which has been mixed with suitable plasticizers in a conventional manner. Typically, the plasticizers are various monomers incorporated in a range generally between four percent and ten percent, by weight of plasticizer, to the basic nylon material. Monomeric amides of many different types are suitable for use in this process; and these monomeric amides are well known. The addition of the amide causes a lowering in the melting point of the finished product, but does not cause it to soften over a wide range. In the case of high melting polyamides, this lowering of the melting point is desirable, since it then is possible to extrude the material at lower temperatures. The addition of monomeric amides or monomers to the nylon pellets does not materially lower the strength of the end product; and it normally improves both its impact strength and its wear characteristics.

The pellets 80, whether or not plasticizing monomers have been added to them, are placed in a dryer 82 to remove residual water from the material to be extruded. It is necessary to extrude the materials dry (less than 0.20% moisture) in order to avoid processing difficulties and resulting defects in the finished extruded product. After the pellets have been dried in the dryer 82, they are supplied to a conventional extruder 84 which produces a continuous extruded monofilament line. In the past, the line exiting from the extruder typically has been wound or cut to fixed lengths and packaged for use with string trimmers of the different types discussed above. These are the normal manufacturing steps for the manufacture of string trimmer line.

Applicant has verified that whenever nylon monofilament string trimmer line is used in the condition it is in after it is extruded by the extruder 84, the wear on the line in low humidity or dry conditions is considerably greater than the wear on the line under high humidity conditions. It has been predicted that line wear in high humidity environments, such as the Pacific northwest, or Florida, is less than line wear in low humidity environments, such as in the Arizona and New Mexico deserts. Investigating this phenomenon, it has been found that nylon absorbs moisture and becomes less brittle, apparently by changing the glass transition temperature, and thereby causing the line to be more flexible when used in lower temperatures or dry environment.

In the method of the preferred embodiment of this invention, however, the line which has been formed by the extruder 84 then is immersed in water or other suitable moisturizing agent at 86. This exposure to the water is for a period of approximately four to forty-eight hours, depending on the diameter of the line and water temperature, with the water temperature under 100° Fahrenheit. A typical water temperature is 70°.

The characteristics of the nylon monofilament line (and nylon materials in general) subjected to such immersion is that water is added to the monomers in the nylon to a total of approximately six to ten percent by weight of the line. It has been found that an immersion of the line in water for the relatively short time of approximately forty-eight hours or less at 70° F. is sufficient to accomplish this result without leaching the monomers out of the line. After the moisture immersion, the line is packaged in sealed packages at 88 to maintain the moisture content of the line and to cause the humidity level within the package to be as near as possible to 100%.

Figure 2:
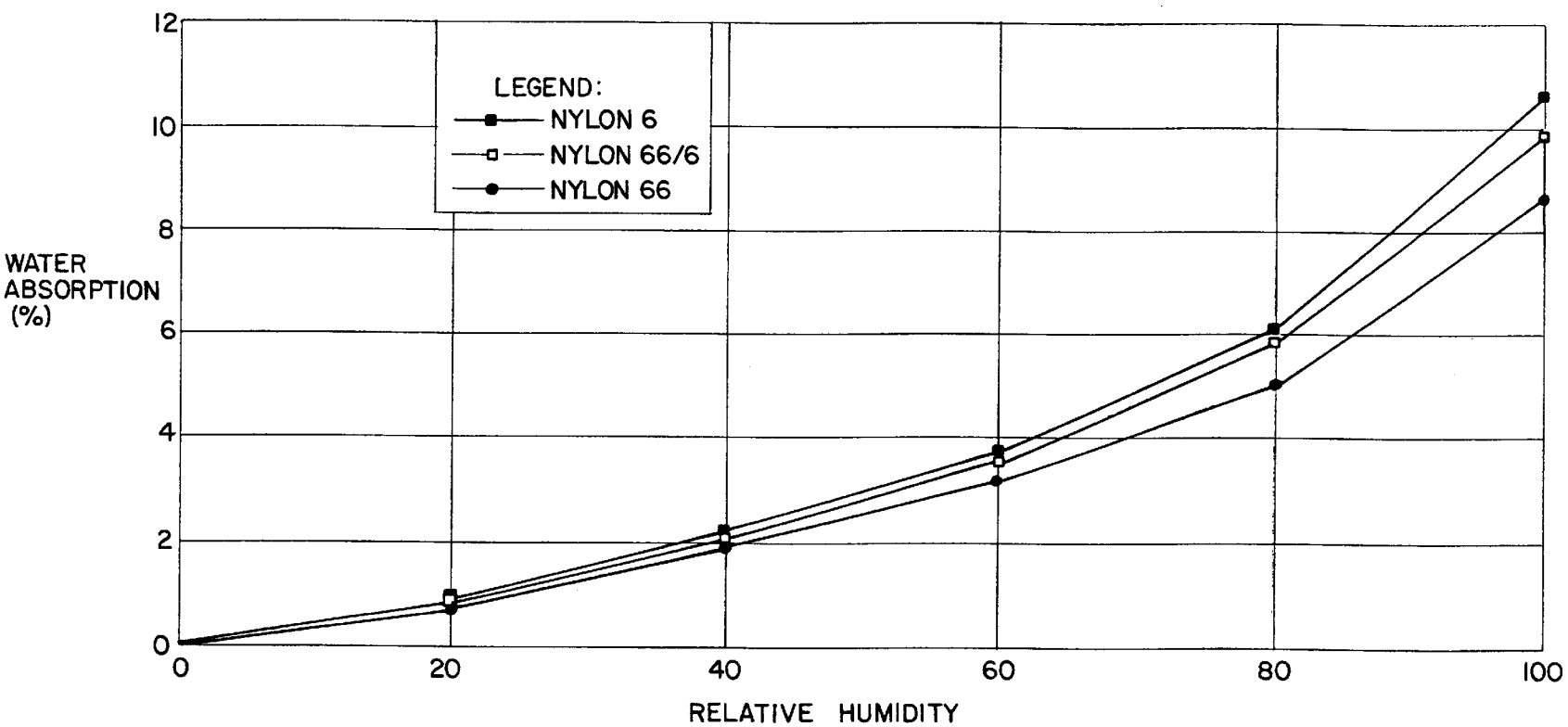
FIG. 2 is a graph showing features of line manufactured in accordance with the method of FIG. 1.

FIG. 2 illustrates the water absorption of three different nylon types, nylon 6, a nylon 66/6 copolymer, and nylon 66. Technical information relating to water absorption of all of the numerous types of nylon is available, but FIG. 2 is representative of the ones that may be used in the manufacture of grass trimmer line and is used for purposes of illustration. As is apparent, the level of moisture absorption in this illustration is dependent on the type of nylon used and the relative humidity of the environment. Absorption levels of about 10.5% will occur as a maximum for nylon 6, 10% for the nylon 66/6 copolymer, and about 9% for the specific nylon 66 evaluated. It should further be noted that the time required for a sample to reach a specific moisture level will vary substantially, depending on the sample thickness (or diameter), as well as the temperature at which the exposure takes place. It should therefore be obvious that for accelerated conditioning, samples should be submerged in water or other conditioning solutions for a specified period in order to control the degree of conditioning for various line diameters (the larger the diameter, the longer the conditioning period to reach the same level).

To maintain the moisture content of the line at the highest level shown in FIG. 2, the line must be placed in a sealed package. Ideally, it should maintain a level close to 100% humidity; but a level above 50% relative humidity should provide adequate conditioning for a marked improvement in performance. At 50% humidity, all three of the nylons noted above will attain a moisture level of approximately 3% to 3.5%. Using standard moisture absorption curves for nylon 6 (73 deg. F. @ 50% relative humidity) it would take approximately 36 days for a cylinder of ⅛" (0.125") in diameter to reach its equilibrium moisture level of 3–3.5%.

To further confirm the importance of line packaging as a means to maintain the essence of the conditioning of the trimmer line, an experiment was conducted to verify levels of moisture absorption. Three sizes of line were selected from production stock stored in the plant warehouse. Conditions are not controlled in this area, but evaporative cooling is used to provide an acceptable working environment. This type of cooling, by its nature, increases the humidity to effect cooling. The humidity of storage could therefore be estimated to have caused the line to absorb from 2–3% moisture prior to initiating the test sequence. Each of the three samples were wound to present a coil of approximately 250 grams, and then conditioned by submerging the line in water for twenty-four hours. Weight measurements were accurately made before and after exposure to the water in order to determine the relative moisture pick-up. Once this was determined, the coils were placed in an outdoor shed in order to expose the samples to environmental drying conditions, yet protect them from direct sunlight. Conditions were monitored daily in order to record the high and low temperature and humidity. Weight measurements were taken daily for five consecutive days, then again on the ninth and the fourteenth days. Since this experiment was conducted in the Arizona desert during mid-summer, temperatures were high and humidities were low, leading to rapid drying conditions. After two weeks of environmental drying, the samples were moved into the warehouse once again where they were exposed to an environment of 30–50% humidity and temperatures ranging from 70 degrees F. to approximately 85 degrees F. Weights were again monitored, with values recorded after four and six days.

Figure 3:
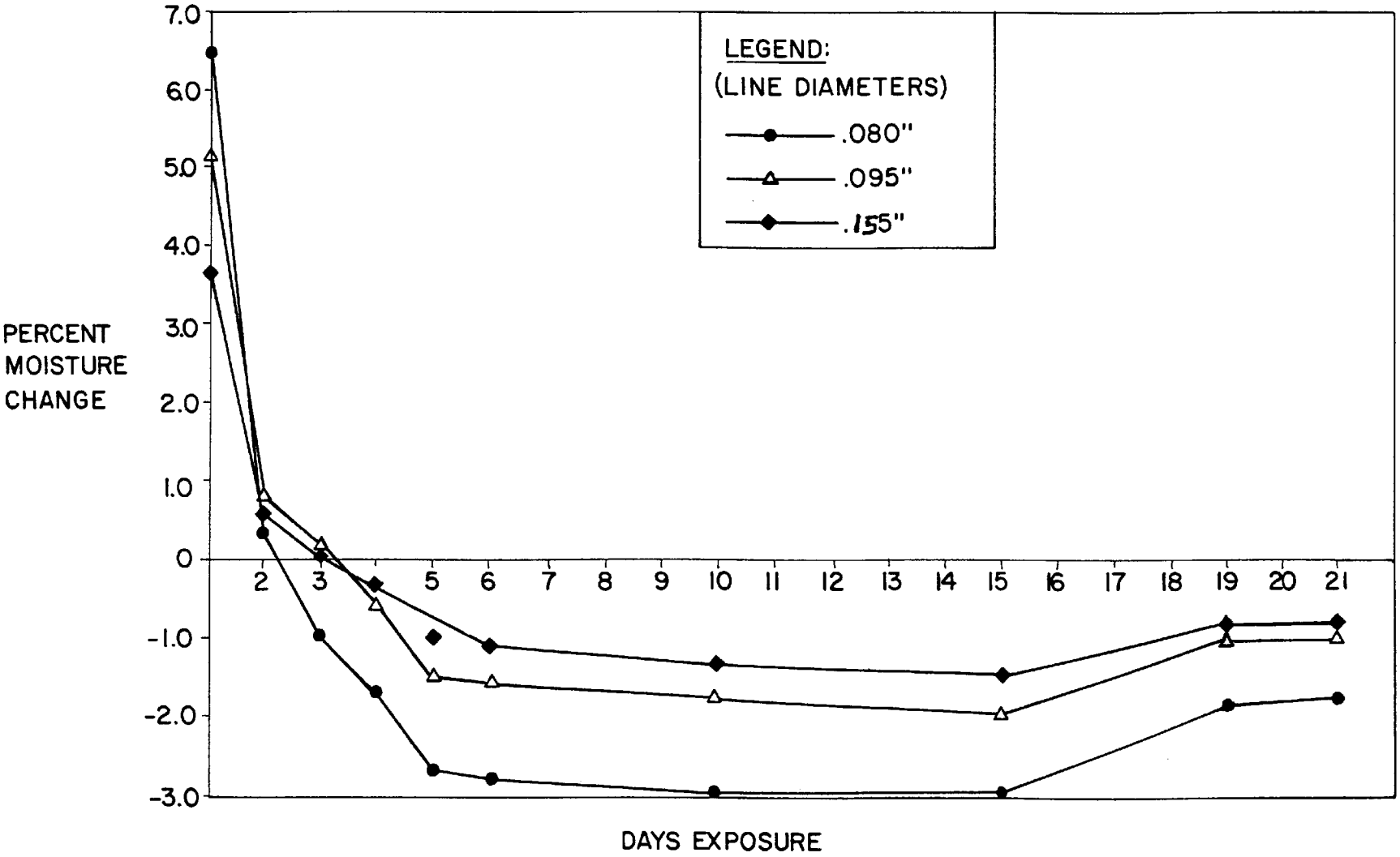
FIG. 3 is a graph showing characteristics of line manufactured in accordance with the method of FIG. 1.

Table 1 and FIG. 3 show the dramatic changes that the trimmer line undergoes with respect to the fluctuation of moisture content. The twenty-four hour soaking showed the lines gaining 3.60%; 5.10% and 6.40% moisture for the 0.155"; 0.095" and the 0.080" lines, respectively. This verified the reported laboratory data showing gain rate is dependent on part thickness.

TABLE 1

| EXPOSURE | | WEIGHT CHANGE LINE SIZE | | | | |
|---|---|---|---|---|---|---|
| TIME (Days) | EXPOSURE CONDITION | 0.080" (%) | 0.095" (%) | 0.155" (%) | TEMPREATURE (High/Low) | HUMIDITY (Hi/Low) |
| 1 | Soak | 6.4 | 5.10 | 3.60 | n/a | n/a |
| 2 | Dry - Shed | 0.33 | 0.74 | 0.55 | 106/76 | 25/8 |
| 3 | Dry - Shed | −1.00 | 0.10 | 0.00 | 106/77 | 25/8 |
| 4 | Dry - Shed | −1.70 | −0.60 | −0.40 | 106/78 | 21/9 |
| 5 | Dry - Shed | −2.70 | −1.50 | −1.00 | 103/79 | 27/12 |
| 6 | Dry - Shed | −2.80 | −1.60 | −1.10 | 103/77 | 26/12 |
| 7 | Dry - Shed | | | | 103/75 | 25/12 |
| 8 | Dry - Shed | | | | 105/72 | 28/5 |
| 9 | Dry - Shed | | | | 108/75 | 22/5 |
| 10 | Dry - Shed | −3.00 | −1.80 | −1.40 | 111/80 | 19/5 |
| 11 | Dry - Shed | | | | 108/82 | 33/8 |
| 12 | Dry - Shed | | | | 109/83 | 35/11 |
| 13 | Dry - Shed | | | | 107/82 | 33/8 |
| 14 | Dry - Shed | | | | 108/79 | 33/8 |
| 15 | Dry - Shed | −3.00 | −2.00 | −1.50 | 106/81 | 28/15 |
| 16 | Whse. - Evap. | | | | 104/78 | 47/14 |
| 17 | Whse. - Evap. | | | | 103/79 | 39/14 |
| 18 | Whse. - Evap. | | | | 104/77 | 29/7 |
| 19 | Whse. - Evap. | −1.90 | −1.06 | −0.90 | 109/83 | 35/11 |
| 20 | Whse. - Evap. | | | | 107/82 | 33/14 |
| 21 | Whse. - Evap. | −1.80 | −1.06 | −0.86 | 110/80 | 35/11 |

Moisture levels dropped at a surprisingly high rate when exposed to the outside conditions. The samples actually lost more weight than was initially reported for moisture pick-up, resulting in a net weight loss for the samples. This is easily explained, as (1) a small loss of plasticizer probably occurred during the twenty-four hour soaking period, and (2) some moisture which was subsequently lost was absorbed prior to the initial weighing. After the coils were placed in the warehouse environment, weights began to rise slowly, as shown in FIG. 3. This verified the slow rate of regain under these conditions, and verified the limited amount of moisture that would be absorbed.

Although standard extruded monofilament nylon trimmer lines can be conditioned by adding moisture, up to about 10% by weight of the line, in the manner described above (that is, by immersing the line in water after extrusion), other plasticizing agents may be used in conjunction with added fluids, such as water or alcohol, or other hydroxyilated non-solvents. Particularly, alcohols such as methenol, n-propyl alcohol, isobutyl alcohol, benzyl alcohol, cyclohexanol, hexamethylene glycol, and glycerol may be employed in place of or along with the solutions in water.

As mentioned previously, the nylon starting pellets 80 may also be combined with or mixed with monomeric amides including ethanol formamide, stearamide, lauramide, benzamide, salicylamide, tetrabutyl adipamide, tetrabutyl phthalamide, bis-ethynol adipamide, bis-diethynol adipamide, bis-ethynol diglycolamide, acetamide, N-diphenyl lauramide, accto-acctamide, diacetyl derivitive of ethynol amine, triprophonyl derivative of diethanol amine, p-toluene, sulfonamide, N-butyl-p-toluene sulfonamides, n-diamyl-p-toluene sulfonamides, toluene sulfonamide, cyclohexane sulfonamide, cyclohexane 1.4-disulfonamide, N-isobutyl cyclohexene sulfonamide, N-phenyl cyclohexene sulfonomide, N-(2-ethylhexy), cyclohexane sulfonamide, N-dimethyl cyclohexane sulfonamide, N-ethyl sulfonamide, N-butyl-benzine sulfonamide, naphthalene sulfonamide, and N-ethyl naphthalene sulfanomide.

These monomeric amides may be added and, alone or with water or alcohols, are used to achieve the moisturizing absorption (water alone, alcohol alone, monomeric amides alone, or any combination of the three) to reach what is indicated as "water absorption" percentage on the relative humidity chart of FIG. 2. Whatever the combination used, the range desired at 100% humidity is between six percent and twelve percent absorption by weight of the total weight of the string trimmer line, with the typical range being substantially between 8% and 11%, by weight.

Figure 4:
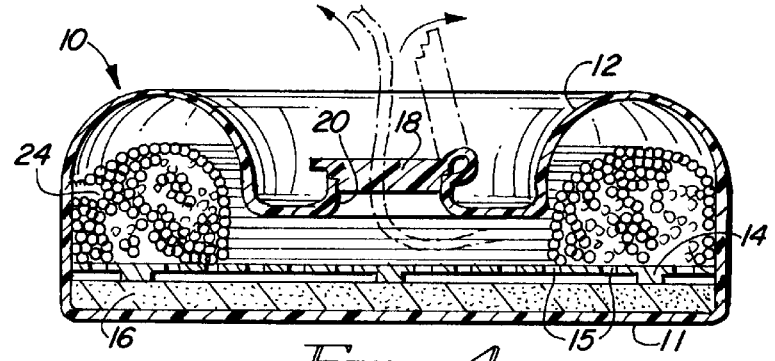
FIG. 4 is a cross-sectional view of a package used in conjunction with the embodiment shown in FIG. 1.

Reference now should be made to FIG. 4, which illustrates a type of sealed package which may be used at step 88 of the process shown in FIG. 1. The package of FIG. 4 is a sealed plastic container 10 made of any suitable watertight material. Ideally, but not necessarily, the package 10 is made of clear transparent material. The container shown in FIG. 4, when viewed from the top, is circular in shape; so that all cross sections are comparable to the cross section shown in FIG. 4. A sponge 16 made of suitable natural or man-made materials is placed in the bottom 11 of the container and is filled with water or other wetting agents of the type described above to maintain the humidity level within the container at or near 100%. Immediately after the string 24 is removed from its moisture immersion 86 (if that is the step in the manufacturing process which is used), or prior to a time when the string 24 could lose the absorbed moisture, it is placed in the container 10 in a donut-like ring, as shown in FIG. 4. This is a conventional configuration for string trimmer line packaging, which typically holds the line in a donut or circular configuration. It is preferred that the line 24 be placed on top of a perforated plastic shelf 14, which holds the line out of direct contact with the sponge material 16 but allows the moisture content of the sponge 16 to permeate the interior of the container 10.

The top 12 of the container 10 has a depressed center to permit the string trimmer line 24 to be coiled around it in the donut-like configuration shown. A circular opening 20 is formed in the center depression of the top 12; and this opening is closed by a hinged circular cap or plug 18, which makes a secure frictional fit with the raised edges of the opening 20. This seals the container 10 for storage and shipping.

When a length of line 24 is desired to be withdrawn from the package, the cap 18 is lifted to the dotted line position shown in FIG. 1; and the line 24 is withdrawn through the opening 20, as illustrated in dotted lines in FIG. 1. After the desired length of line has been withdrawn and cut off, the cap 18 once again is pushed down into place to frictionally secure and seal the opening 20 to maintain the high humidity atmosphere within the interior of the container 10. By storing the line 24 in the manner described above in conjunction with FIG. 4, the high level of water absorption which is placed in the line at its manufacture is maintained; so that it will have its maximum wearability when it is used.

Figure 5:
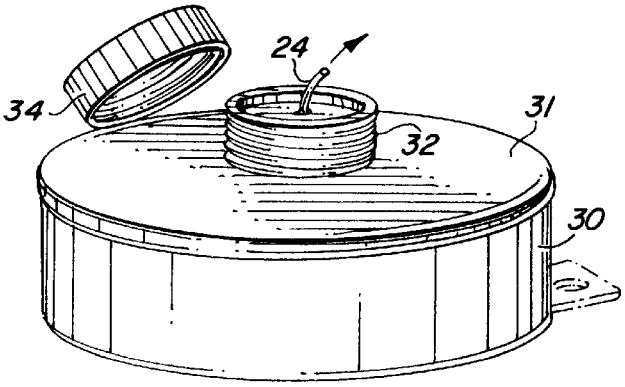
FIG. 5 is an alternative package to the one shown in FIG. 3.
Figure 6:
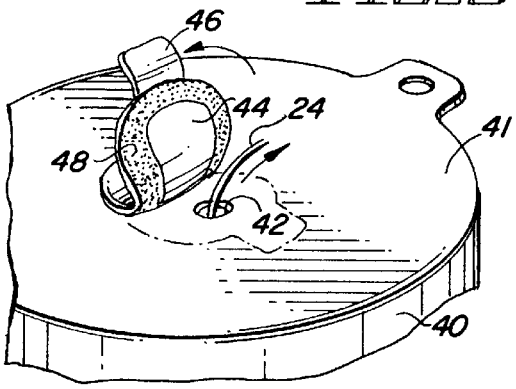
FIG. 6 illustrates another variation of a feature of the packages shown in FIGS. 3 and 4.

FIGS. 5 and 6 illustrate alternative packages to the one shown in FIG. 4. FIG. 4 shows a short cylindrical container 30 having a top 31 with a threaded opening 32, which is releasably sealed by a screw-on type cap 34. The line 24 is withdrawn from the opening 32 when the cap 34 is removed, as shown in FIG. 5. In all other respects, the container of FIG. 5 functions in the same manner as the one shown in FIG. 4.

FIG. 6 is another alternative showing another circular container 40 with a top 41. The top 41 has a hole 42 formed in it for withdrawal of the end of the line 24, as shown. The hole 42 is resealed with a flexible cap 44 having a resealable adhesive around its periphery and a tab 46 to permit it to be lifted and then pushed back down into place to seal the opening 42. Typically, the cap 44 is made of aluminum or aluminized plastic; and any conventional resealable adhesive 48 of the type commonly used with such seals may be employed.

Figure 7:
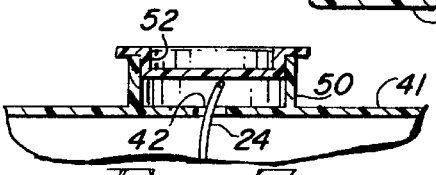
FIG. 7 and FIG. 8 are cross-sectional views of additional variations of a feature of the packages shown in FIGS. 3 and 4.
Figure 8:
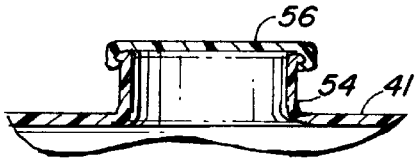

FIGS. 7 and 8 show other variations of openings and caps which may be made to maintain the sealed interior of any one of the containers shown in FIGS. 4 through 6 until a length of trimmer line 24 is to be withdrawn, at which time the caps are removed. In FIG. 7, a raised central cylindrical neck extends around an opening 42 of the type shown in FIG. 6. A friction fit cap 52 then is pressed down inside the upper end of the neck 50 when the container is sealed. To remove a length of trimmer line 24 from the container illustrated in FIG. 7, the cap 52 is removed and the length of line 24 is withdrawn through the neck 50.

FIG. 8 is a variation of the structure shown in FIG. 7 but includes a raised neck 54, which extends from a larger opening of the type shown in FIG. 4. This opening 54 is closed by a press-on friction fit cap which is capable of removal in order to withdraw line 24 from the container, including the opening shown in FIG. 8.

Figure 9:
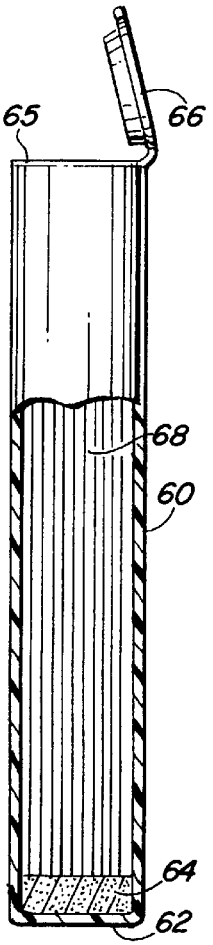
FIG. 9 is a cross-sectional view of another package embodiment of the invention.

Reference now should be made to FIG. 9, which illustrates another embodiment of a sealed package which may be used in conjunction with the method of manufacturing the trimmer line described above. In the embodiment of FIG. 9, cut, straight strips of trimmer line 68 are packaged in an elongated cylindrical container 60 having a bottom 62 with a sponge 64 filled with moisturizing liquid (preferably water), much in the same manner as described above in conjunction with the embodiment of FIG. 4. The strips of trimmer line 68 have an overall length which is selected to be shorter than the length of the container 60; so that the open top of the container 65 may be closed with a resilient cap 66 similar to the cap 18 used in the embodiment of FIG. 4. In all other respects, the container of FIG. 9 functions in the same manner as the container of FIG. 4 Whenever one or more of the trimmer line strips 68 is to be used, the cap 66 is opened to the position shown in FIG. 8 and the desired number of cut lengths of trimmer line 68 are removed from the container 60. Then the container is resealed by pressing the cap 66 tightly into engagement with the open end 65 of the container to reseal it, providing a sealed container.

Figure 10:
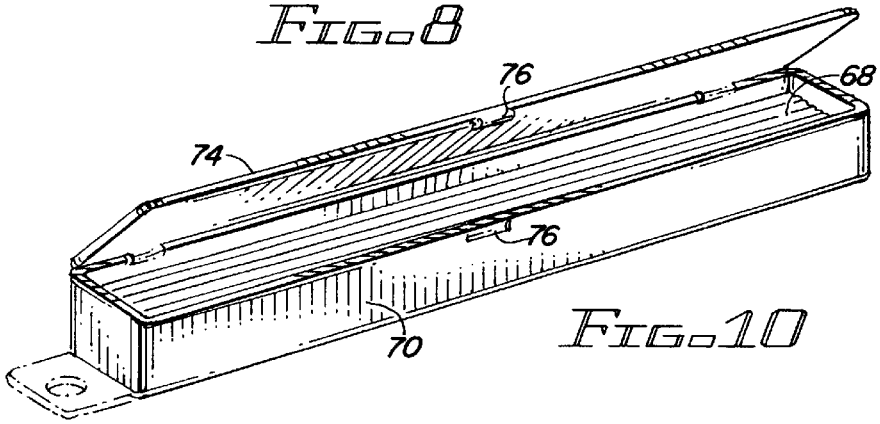
FIG. 10 is a further embodiment of a package according to the invention.

FIG. 10 is a variation of the embodiment shown in FIG. 9 for holding cut strips of trimmer line 68. In the embodiment of FIG. 10, a rectangular box 70 is employed, with a hinged cap 74 and having a latch 76 to hold the lid tightly in place over the strips 68 except during such times as removal of one or more strips is desired. The container of FIG. 10 also is sealed when the strips 68 are stored or are being shipped.

It should be noted that while a sponge or sponge-like material 16 and 64 has been shown in conjunction with FIGS. 4 and 9, such sponges could be dispensed with provided the container is filled with trimmer line 24 or 68 having the desired percentage of water absorption and the containers shown in the various figures of the drawing have a high internal humidity at the time the container is sealed. Whenever the containers shown in the various FIGS. 4 through 10 are sealed, the humidity level within the container remains stable; so that a stable condition of the treated or conditioned line exists. The sponges 16 and 64, however, are helpful to maintain a humidity level over a long period of time when repeated opening and closing of the container takes place prior to withdrawal of all of the line 24 or 68 from the respective container has been effected.

Also, while the shelf 14 keeps the lower turns of the line 24 out of direct engagement with the fluid-filled sponge 16, the shelf could be eliminated in some situations. The spacer 14 appears to be desirable, however, to prevent unwanted leaching out of the monomers from the lowermost turns of the coil of line 24, which possibly could occur if a saturated sponge 16 was in prolonged contact with these lowermost turns of the coil of line 24.

In working with the conditioned-line packages shown in FIGS. 4 through 10, it has been established that some provision to indicate whether the water absorption percentage of the line within the containers is at an acceptable level is helpful. Moisture/humidity indicators which appear suitable for this purpose are copper chloride and cobalt chloride. There may be other indicators; but these materials undergo a significant color change indicative of moisture absorption or the presence of moisture in a container.

As a trial, a solution of 0.1% (by weight) of cobalt chloride was added to the water used in the processing method depicted in FIG. 1 at the immersion step 86. The absorption is sufficient to "dye" the trimmer line 24 or 68, as shown in FIGS. 4 through 10. For cobalt chloride, the line is light pink when moisture in the line is relatively high (above about 40%), and blue when the line reaches lower levels of moisture (less than about 10%). It is possible by varying the concentration of the cobalt chloride to adjust the intensity at which the color changes. The point of color transformation is not exact, but is adequately representative of the moisture level in the line for general performance purposes. It should also be noted that standard humidity indicators using this type of indicating metallic salt are commercially available. These indicators have small dots of the salt solution applied to absorbent type paper. When placed in a humid environment, the dot changes color giving a relatively accurate indication of humidity.

Alternatively, the indicating solution may be applied to the product surface through an appropriate coating step. In this method, the indicating salt is incorporated in a coating formulation, which may be a lubricating material or other surface modifying component. The coating should preferably be hygroscopic, in which case the color change occurs as moisture is gained or lost on the surface of the trimmer line.

A third method would incorporate the addition of the indicating metallic salt, in adequate concentration, during a compounding step prior to extrusion. Here, the salt may be added to the nylon chips, processed in a compounding extruder or other appropriate melt blending device, pelletized, dried and stored for future processing.

A fourth technique would be to spray a concentrated solution of the selected indicating salt onto the nylon chips. The chips are allowed to stand for an appropriate time so as to absorb the indicating salt. The nylon chips would then be dried to a moisture level of about 0.18% or less to allow for subsequent extrusion. The indicating salt, which was absorbed by the plastic, remains in the nylon giving it the ability to indicate moisture levels during future use.

A fifth method would be to incorporate the indicating salt during the feeding of monomers and catalyst solutions to the reactor, prior to, or during the polymerization step. In this method, the solution would be completely dispersed and no additional processing step would be necessary.

It has been found that string trimmer line which has been prepared and packaged as described above exhibits significantly improved wear characteristics over untreated line of the same type. This results in wear ratio improvements between 2:1 and more than 5:1 for the conditioned or treated line compared with the same line formulations which are unconditioned.

In order to test the operation of treated or conditioned line manufactured in accordance with the foregoing description, samples of various types of trim line were extruded for the test. For each sample run, some of the line was untreated and otherwise identical samples from the same extrusion run were treated or conditioned in accordance with the method described above in conjunction with FIG. 1, namely by immersing the line in water for 24 hours prior to packaging it until it was used.

To make the comparative tests, half of the samples, as described above, were placed immediately into a large heavy-duty sealed plastic bag after extrusion. The other half of the line samples (from each of the different extrusion runs) were placed in a water vat, submerged, and allowed to condition for 24 hours. These conditioned samples then were removed, hand dried to remove residual surface moisture, and immediately placed in large sealed plastic bags. Polyethylene bags were selected so as to maintain the moisture content of the samples until tests were performed and to prevent any external ambient air factors from influencing the line samples in either of the bags.

The test site was selected with a heavy and uniform grass density. Each test site comprised four different adjoining plots of approximately 1,200 square feet. A course layout was made. Each of these plots were ten feet wide and 120 feet long. Posts were inserted at each of the corners, and strings were attached to each pair of posts to lay out the plots. A clear swath of about seventeen inches was cut between the four different sections to clearly indicate to the machine operators the boundaries of the test sections and to avoid any extraneous cutting beyond the grass within the test sections. For the purposes of the test, four different lines manufactured from different formulas, and some having different diameters, were tested simultaneously using four different trimmers and four different operators.

The lines were rotated between the operators; so that each line was tested four (4) times, once by each operator. By doing this, the effect of the operator, machine or section variability was eliminated to as great an extent as possible. Each of the string trimmer test machines was equipped with line samples by a "scorer". The line was measured in ⅛" divisions to ensure proper line length. Two measured line sections were attached on opposite sides of each trimmer hub before testing began; and the lines were trimmed to an exact five inch length for each of the two line extensions on each side of the hub to which the lines were attached. For a typical head diameter or hub diameter of 4½", a cut path of 14½" thus was made for each of the trimmers.

This test line length was chosen so that each test trimmer would maintain a rotary speed of at least 8,800 RPM with the lines extended and the trimmer at full throttle. Once this set up had been done, the operators were assigned a cut section and instructed to begin. Cutting continued until the section was completely cut, a line broke, or the line was worn so as to inhibit further cutting. The latter case was considered to occur when the line was worn to a residual length of about 2½" (one-half its original length).

Upon completion of each cut section, the "scorer" measured the length of trim line remaining on the head. The length was determined to the nearest ⅛"; and that length was entered on a lined score sheet. Line splitting also was measured; and the split amount entered to the nearest ⅛". Line wear was determined as the beginning line length less the final line length for both pieces of line of the fixed head. Relative wear was determined by dividing the total length of line used by the area cut, in thousand square feet. That is, 4.8" of wear for two lines on a hub which cut 1,200 square feet would be 4.8/1.2=4.0 IN/$M^2$ FT, or in other words, 4" of line wear per 1,000 square feet of cutting.

If the cut section could not be completed due to excessive line wear, the scorer measured the section which was completed. That area then was used in the relative wear determination. A separate sheet was maintained for each line sample. Normally, one scorer observed and scored for two line trimmers. This helped to assure that tests were being conducted on a uniform basis, and that similar cutting techniques were being used. Since performance variations in formula can be effected over a relatively wide range, depending upon the polymer molecular weight, plasticizer percentage, and the like, comparative tests of one type of line to another would be inconclusive. The tests which were run, however, took line from the same formulation and manufacturing or extrusion technique with some of the line being tested as "dry" (that is, untreated) and the comparative line being one which had been immersed in water as described above (conditioned), but in all other respects identical to the same sample of untreated or dry line. When this was done, the following results were obtained from tests run in accordance with the foregoing procedure.

TABLE 2

| RANK | SAMPLE DESIGNATION | LINE CONDITION | WEAR LEVEL (in./m sq. ft.) |
|---|---|---|---|
| | | TEST 1 (.095") ROUND LINE | |
| 1 | A | CONDITIONED | 1.45 |
| 2 | B | CONDITIONED | 1.98 |
| 3 | B | DRY | 5.42 |
| 4 | A | DRY | 7.44 |
| | | TEST 2 (0.080") ROUND LINE | |
| 1 | D | CONDITIONED | 5.12 |

TABLE 2-continued

| RANK | SAMPLE DESIGNATION | LINE CONDITION | WEAR LEVEL (in./m sq. ft.) |
|---|---|---|---|
| 2 | C | CONDITIONED | 7.82 |
| 3 | D | DRY | 12.4 |
| 4 | C | DRY | 25.09 |

From the foregoing it can be seen that the conditioned line substantially improved line wear performance for lines having otherwise identical characteristics. Comparative tests of one type of line to another type of line to obtain the optimum formulation for conditioned line, should be made for determining the ultimate best combination of factors for the longest wear. It should be noted, however, that for any given line, the conditioning significantly improved the wear characteristics of the line. As mentioned previously, natural climatic differences which exist both nationally and worldwide have an effect on line performance. Cold, dry climates should show the poorest performance for unconditioned or untreated line, while moist, warm environments provide much better line wearability, even for untreated or non conditioned line as conditioning will occur naturally if allowed to reside for a sufficient time in humid conditions. This at best may take several weeks to months, depending upon the conditions and line diameter.

In conclusion, the following table summarizes the test results for four of the product lines shown in Table 2, which may be considered typical of the test results obtainable from lines of various formulations:

TABLE 3

| PRODUCT | DIAMETER (inches) | COLOR | TEST NO. | WEAR DRY (in./m sq. ft.) | WEAR CONDITIONED (in./m sq. ft.) | WEAR RATIO (run/cond.) |
|---|---|---|---|---|---|---|
| A | 0.095" | NATURAL | 1 | 7.44" | 1.45" | 5.13 |
| B | 0.095" | NATURAL | 1 | 5.42" | 1.98" | 2.74 |
| C | 0.080" | NATURAL | 2 | 25.09" | 7.82" | 3.21 |
| D | 0.080" | NATURAL | 2 | 12.40" | 5.12" | 2.42 |

Table 3 above clearly shows the significantly increased wear qualities for line conditioned in accordance with the above method of preparation. The four line formulations which are indicated under the column called "PRODUCT" all showed significant improvement for the conditioned line over the "dry" or non-conditioned line used in each of the different comparative tests. As is apparent from the above table, the wear ratios varied between a 2.42 improvement to 5.13 for the four different formulations which were used.

In order to verify results obtained in the original wear comparisons, another test series was planned and conducted some 8 months later. The first tests indicated in Tables 2 and 3 were performed in a mountainous region of Arizona at an elevation of approximately 10,000 feet. Temperatures ranged from the low 40° to low 50° F. level, while the humidity varied between 70% to 98%. This was in mid-September.

Test results shown in Table 3 were conducted in the desert region of Arizona in mid-May. In that location, the elevation was approximately 1,000 feet, temperatures ranged from 80° to 90° F.; and the humidity stayed at levels between 20% and 30%. Test procedures were the same as those developed for the tests whose results are represented in Table 2 and Table 3. However, an improved control of grass density was attained, since a field of commercial grain grown to our specifications was used as the test area. Thus, grass densities were extremely consistent and test variability reduced.

As an additional step, lines were evaluated after allowing the moisture to equilibrate in several of the samples for an extended period of time. The initial condition procedure used was essentially the same as that used in the test results presented in Tables 2 and 3. The first sample was immersed in water for 12 hours, placed in a polythylene bag and allowed to equilibrate for 8 days. A second sample was treated some 5½ days later, placed in a polyethylene bag and allowed to equilibrate for 2½ days. A third sample was submerged for 12 hours in water, then bagged immediately prior to commencing the test. A retain of the sample, as produced, was placed in a polyethylene bag immediately after extrusion, from which the other samples had been drawn. In this fashion it could be determined if a significant effect occurred as moisture equilibrium took place over the extended holding period.

From the results reflected in Table 4 below, it is once again obvious that significant wear reduction takes place when the trimmer line is conditioned appropriately. It was further observed that an additional residence in a closed container for several days served to enhance the performance of the trimmer line. This latter effect is certainly less substantial than the initial submersion, but nonetheless offers measurable line performance improvement.

TABLE 4

| PRODUCT | DIAMETER (inches) | SEQUENCE NO. | LINE CONDITION | WEAR (in./m sq. ft.) | WEAR RATIO (in./m sq. ft.) |
|---|---|---|---|---|---|
| B. | 0.095" | 1 | Dry - as - run | 58.11" | n/a |
| B. | 0.095" | 2 | Soak - 12 hours | 18.34" | 3.2 |
| B. | 0.095" | 3 | Soak - 12 hrs. + 2 day set | 17.08" | 3.4 |
| B. | 0.095" | 4 | Soak - 12 hrs. + 8 day set | 14.39" | 4 |

The foregoing description of the preferred embodiment of the invention is considered illustrative and not as limiting. Various changes and modifications will occur to those skilled in the art for performing substantially the same function, in substantially the same way, to achieve substantially the same result without departing from the true scope of the invention as defined in the appended claims.

What is claimed is:

1. A container for monofilament string trimmer line including in combination:

a predetermined amount of monofilament string trimmer line;

a main liquid-impervious hollow container member for holding said monofilament string trimmer line, said container member having a closable opening therein to permit withdrawal of said line from said container member;

a sponge member in said container for holding a predetermined amount of moisturizing fluid; and a releasable closure for the opening in said container member for sealing said container member to maintain a predetermined moisture level therein in cooperation with said fluid-containing sponge member.

2. The combination according to claim 1 wherein said monofilament string trimmer line is made of extruded monofilament nylon material.

3. The combination according to claim 2 further including a spacer member located between said sponge member and said string trimmer line.

4. The combination according to claim 3 wherein said moisturizing fluid is water.

5. The combination according to claim 4 wherein said container member is a generally cylindrical container member for holding a coil of string trimmer line, said container member having a bottom and a top, with said sponge member located in the bottom thereof and said opening located substantially in the center of the top thereof.

6. The combination according to claim 4 wherein said container member has a predetermined length for holding individual sections of monofilament string trimmer line, wherein the length of said individual sections of line is less than the length of said container member.

7. The combination according to claim 1 further including a spacer member located between said sponge member and said string trimmer line.

8. The combination according to claim 1 wherein said moisturizing fluid is water.

9. The combination according to claim 1 wherein said container member is a generally cylindrical container member for holding a coil of string trimmer line, said container member having a bottom and a top, with said sponge member located in the bottom thereof and said opening located substantially in the center of the top thereof.

10. The combination according to claim 1 wherein said container member has a predetermined length for holding individual sections of monofilament string trimmer line, wherein the length of said individual sections of line is less than the length of said container member.

11. A monofilament line and a storage package therefor including in combination:

a main moisture-impervious hollow container member for holding a predetermined amount of monofilament line, said container member having an opening therein to permit withdrawal of line from said container; and monofilament line having a moisture sensitive material causing said line to have a first color when the moisture content of said line is above a predetermined amount and to have a second color when the moisture content of said line is below a second predetermined amount.

12. The combination according to claim 11 wherein said moisture sensitive material is selected from the class of copper chloride and cobalt chloride.

13. The combination according to claim 12 wherein said moisture sensitive material is coated on said line.

14. The combination according to claim 12 wherein said moisture sensitive material is incorporated into said monofilament line.

15. The combination according to claim 11 wherein said moisture sensitive material is coated on said line.

16. The combination according to claim 11 wherein said moisture sensitive material is incorporated into said monofilament line.

* * * * *